United States Patent [19]

Bulso, Jr. et al.

[11] Patent Number: 4,903,521

[45] Date of Patent: Feb. 27, 1990

[54] METHOD AND APPARATUS FOR FORMING, REFORMING AND CURLING SHELLS IN A SINGLE PRESS

[75] Inventors: Joseph D. Bulso, Jr., Canton; James A. McClung, North Canton, both of Ohio

[73] Assignee: Redicon Corporation, Canton, Ohio

[21] Appl. No.: 239,948

[22] Filed: Sep. 2, 1988

[51] Int. Cl.[4] ..... B21D 22/00

[52] U.S. Cl. ..... 72/336; 72/348; 72/361

[58] Field of Search ..... 72/329, 336, 348, 361

[56] References Cited

U.S. PATENT DOCUMENTS

| | | | |
|---|---|---|---|
| 184,708 | 11/1876 | Gordon | 72/336 |
| 1,275,614 | 8/1918 | Sherman | 72/336 |
| 1,984,774 | 12/1934 | Stogner, Sr. | 72/336 |
| 2,695,583 | 11/1954 | Swarr | 72/361 |
| 3,704,618 | 12/1972 | Cvacho et al. | 72/336 |
| 3,812,953 | 5/1974 | Maschke | 198/131 |
| 3,902,347 | 9/1975 | Ridgway et al. | 72/336 |
| 4,483,172 | 11/1984 | Bulso, Jr. et al. | 72/349 |
| 4,516,420 | 5/1985 | Bulso, Jr. et al. | 72/329 |
| 4,535,618 | 8/1985 | Bulso, Jr. et al. | 72/349 |
| 4,549,424 | 10/1985 | Bulso, Jr. et al. | 72/329 |
| 4,561,280 | 12/1985 | Bachmann et al. | 72/346 |
| 4,567,746 | 2/1986 | Bachmann et al. | 72/348 |
| 4,574,608 | 3/1986 | Bulso, Jr. et al. | 72/348 |
| 4,587,825 | 5/1986 | Bulso, Jr. et al. | 72/329 |
| 4,587,826 | 5/1986 | Bulso, Jr. et al. | 72/329 |
| 4,588,066 | 5/1986 | Kaminski | 198/345 |

*Primary Examiner*—Lowell A. Larson
*Attorney, Agent, or Firm*—Reese Taylor

[57] ABSTRACT

A method of forming container end panels from a sheet of material includes inserting the material into a press at a first level, banking the material at that level, passing the material through a die and preliminarily forming it in a continuous stroke but at a second level and transferring it laterally at the second level for reforming and curling. The apparatus includes blanking and forming tooling at a first station and reforming and curling tooling at second and third stations. The reforming and curling tooling is disposed at the second level and the first, second and third stations are interconnected by an endless, apertured belt also disposed at the second level.

21 Claims, 11 Drawing Sheets

Y FIG. 2 Y

METHOD AND APPARATUS FOR FORMING, REFORMING AND CURLING SHELLS IN A SINGLE PRESS

BACKGROUND OF THE INVENTION

This invention relates in general to a system, method and apparatus for forming container end panels, commonly called shells, from a sheet of material and relates in particular to such a system in which the entire operation on the end panel from the initial raw material to the finished end, including blanking, forming, reforming and curling, is accomplished in a single press, while positively controlling the shells throughout the process and greatly increasing the speed of operation.

DESCRIPTION OF THE PRIOR ART

The forming of ends or shells for containers can be seen from Bulso U.S. Pat. Nos. 4,516,420 and 4,549,424 and the reforming thereof can be seen in Bulso U.S. Pat. Nos. 4,587,825 and 4,587,826. Similarly, curling operations and apparatus can be seen in Bulso U.S. Pat. No. 4,574,608. Through the die forming of containers per se can be seen in Bulso U.S. Pat. Nos. 4,483,172 and 4,535,618.

Also, representative of the prior patent art are Bachmann U.S. Pat. Nos. 4,561,280 and 4,567,746 which disclose methods and apparatus for making shells for cans including imparting a curl edge to the finished product. Additionally, Maschke U.S. Pat. No. 3,812,953 and Kaminski U.S. Pat. No. 4,588,066 are relevant as disclosing article transfer by apertured, endless belts.

Thus, the various operations contemplated in the present application are, to at least some extent, in and of themselves known to the art. Accordingly, it is known to blank material from a sheet or coil; it is known to form and reform the material; and it is known to curl the peripheral edge for a double seaming operation. However, the combination of all of these features in a single press capable of extremely high speed operation with a minimal amount of handling of the end panel or shell has not heretofore been known in the art and it is this unique combination which is the subject of the present application.

In that regard, in a conventional operation, where, for example, the shells are formed and then converted to pull tab ends, the press will have tooling capable of forming twenty-two shells per stroke. Thus, such a twenty-two out press, operating at one hundred fifty strokes per minute, would produce thirty-three hundred shells per minute.

However, typical conversion equipment can convert forty-two hundred shells per minute. Thus, in order to take advantage of the conversion capacity, it would normally be necessary to add a second shell press which doubles the shell production cost. Since the goal is to reduce the cost per thousand, this is not a satisfactory solution.

An alternative solution is to speed up the shell press. However, control of the ends becomes a serious problem at higher speeds and leads to damaged ends which is counterproductive.

Accordingly, Applicant has found, by a combination of multi-level feeding and handling and positive belt transfer, that speeds of up to or exceeding two hundred strokes per minute can be achieved without undue end damage.

Such a system makes it possible to eliminate transfer line interferences, reduce tooling stations and machine manning while enabling the shell technology to keep pace with the conversion technology and reduce the cost per thousand.

SUMMARY OF THE INVENTION

It, accordingly, becomes an object of the present invention to combine in a single press the functions of blanking, forming, reforming and die curling.

It is also an object of this invention to achieve in a single press the various operations just referred to with a minimal amount of handling of the article and with positive control during the various forming steps as well as during the transfer steps.

It has been found that these objects can be achieved by feeding the stock into the press at one level, providing for blanking, drawing and redrawing in a single station by passing the material through the die and depositing it in an apertured belt or a different level for transfer to a reforming and curling station. It has been found that in this fashion no handling of the article is required through the blanking, drawing and reverse drawing operations, thereby minimizing the risk of damage to either the article or to the coating which the article carries in many instances. It has also been found that the multi-level approach avoids transfer line interference problems while permitting very high speed operation.

It has also been found that, by arranging the tooling stations so that the blank, draw and redraw stations are arranged along the axis of feed of the material and then disposing the reforming and curling stations laterally with respect to the direction of feed, a positive belt transfer can be employed even with extremely lightweight materials which are not readily susceptible to effective transfer by air at very high press speeds.

Accordingly, production of an improved method and apparatus for forming, reforming and curling shells in a single press becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

It will first be noted that the invention is illustrated in a double acting press wherein the press has inner and outer slides, each of which carries certain tooling and each of which is capable of being operated and adjusted independently of the other so that the tooling carried by a particular slide can perform its functions independently of, but in coordination with, the tooling of the other slide. Such presses are well-known in the art and a representative one can be seen in Ridgway U.S. Pat. No. 3,902,347.

Figure 1:
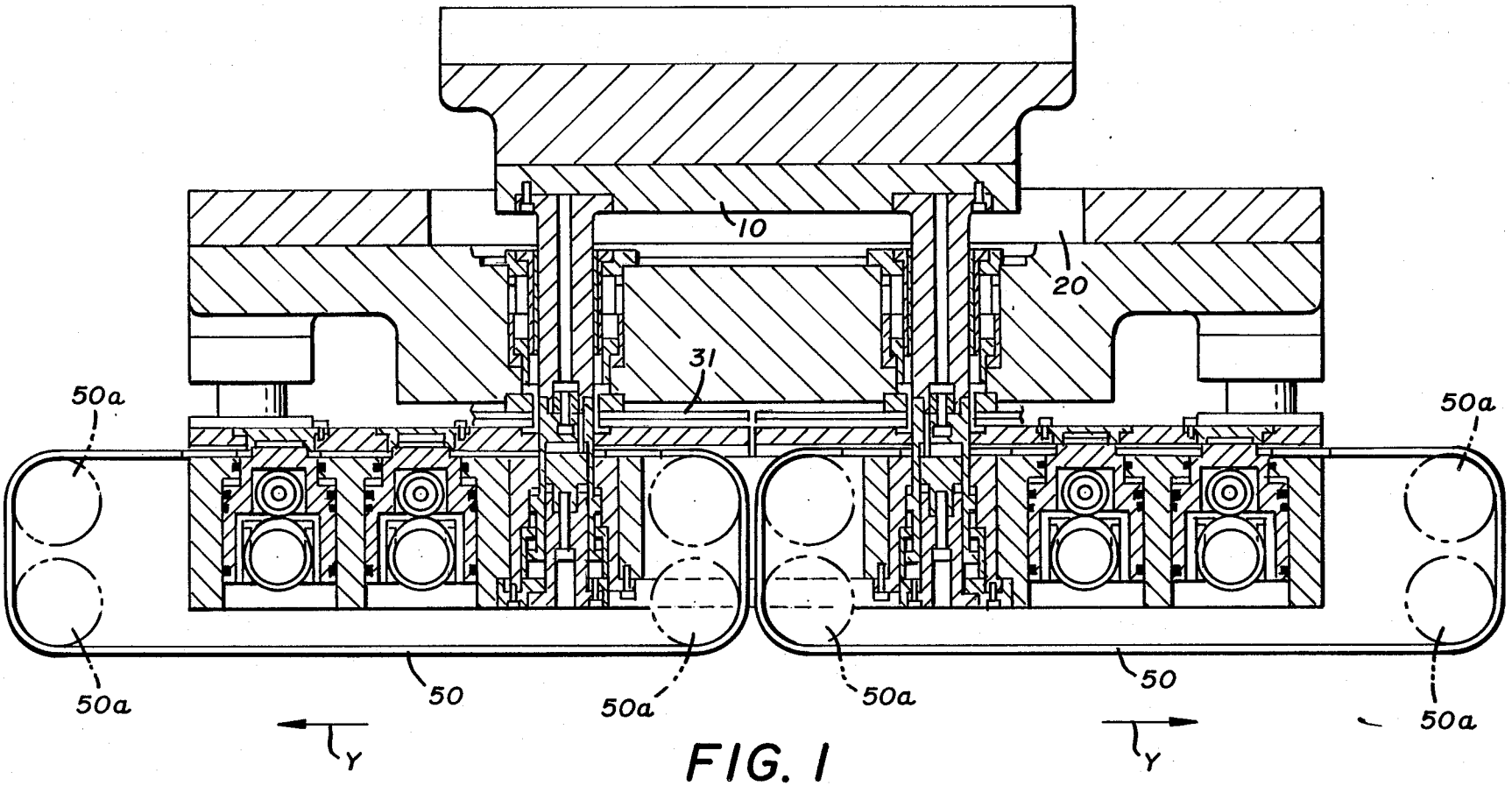
FIG. 1 is an elevational view, partially in section, showing the overall arrangement of the system.
Figure 2:
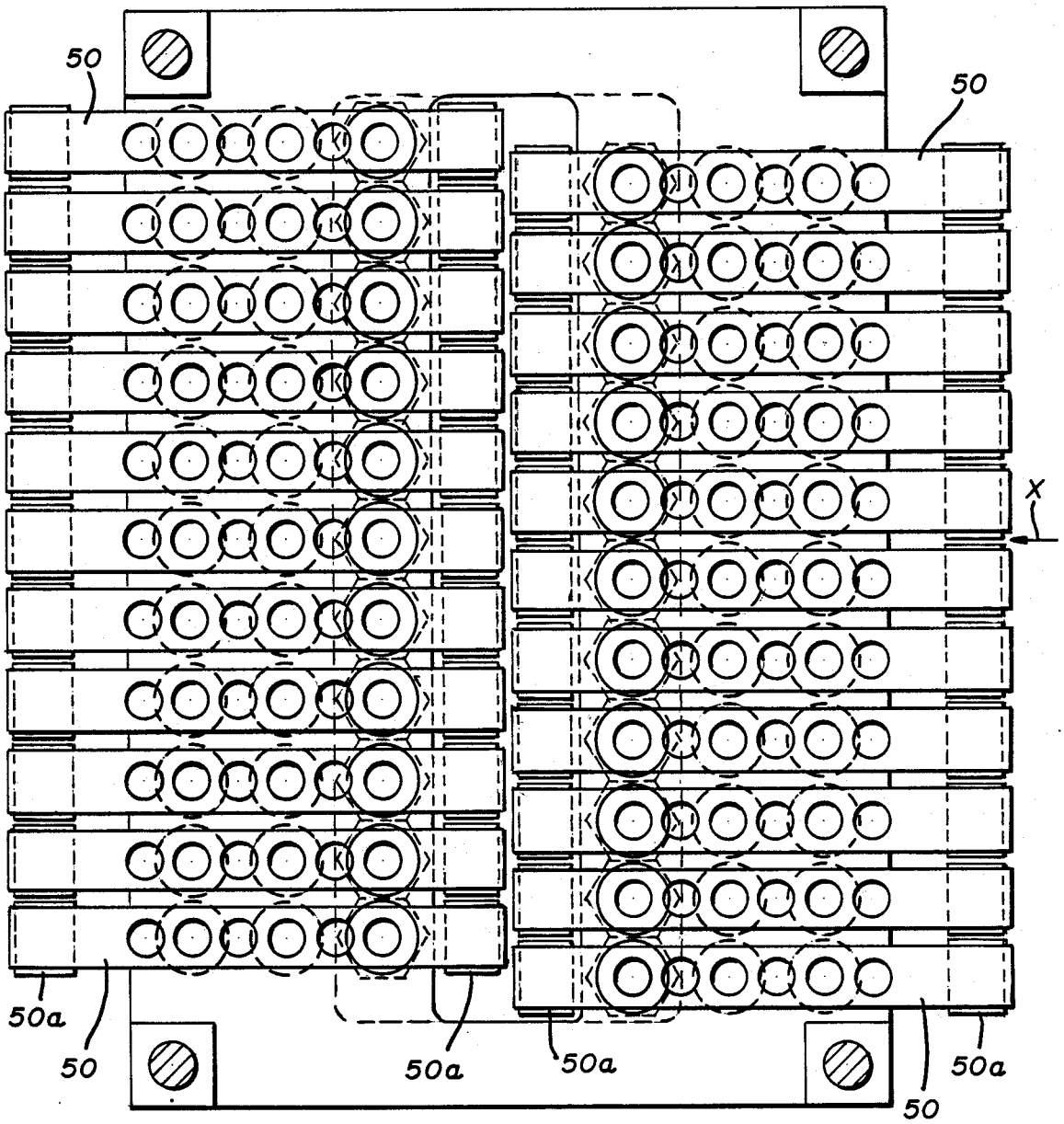
FIG. 2 is a plan view of the tooling layout showing the blanking position.

Referring first to FIGS. 1 and 2 of the drawings, the overall arrangement can be clearly seen. As previously noted, the double acting press includes inner and outer slide holders 10 and 20 which carry the tooling for blanking and preliminary forming the shell. These slide holders are movable toward and away from the press base as is conventional.

The tooling is arranged as shown in FIGS. 1 and 2 along the axis of feed X of the material into the press so that, as the material is fed along axis X, each cycle of the press will enable the tooling to blank and form shells in a number corresponding to the sets of tooling. In the illustrations of FIGS. 1 and 2, this amounts to twenty-two (eleven on each side of the centerline).

FIGS. 1 and 2 also illustrate how the arrangement permits utilization of a belt transfer since, once the shells are preliminarily formed, they are moved out of the preliminary forming stations to the secondary stations on belts 50,50 in the directions Y. It should be noted here that the invention contemplates what may be called a multi-level arrangement. Thus, referring to FIGS. 1, 2 and 3, the material is fed into the press in the direction X (See FIG. 2) along a stock plate 31 (See FIG. 3) which is disposed on a first level and the preliminarily formed shell is transferred for reforming and curling in the direction of arrows Y (See FIG. 2) on belts 50,50 (See FIG. 1) disposed on a second level. This avoids any transfer line interference. It will also be noted from FIG. 1 that there are two parallel sets of tooling mounted in the press and that, after preliminarily forming the shells, are moved away from those sets of tooling in opposite directions Y,Y for subsequent operations.

In the following detailed description, it should be remembered that operation on only one workpiece will be considered, although the operations and tooling will be repeated twenty-two times for each cycle in the example illustrated.

Figure 3:
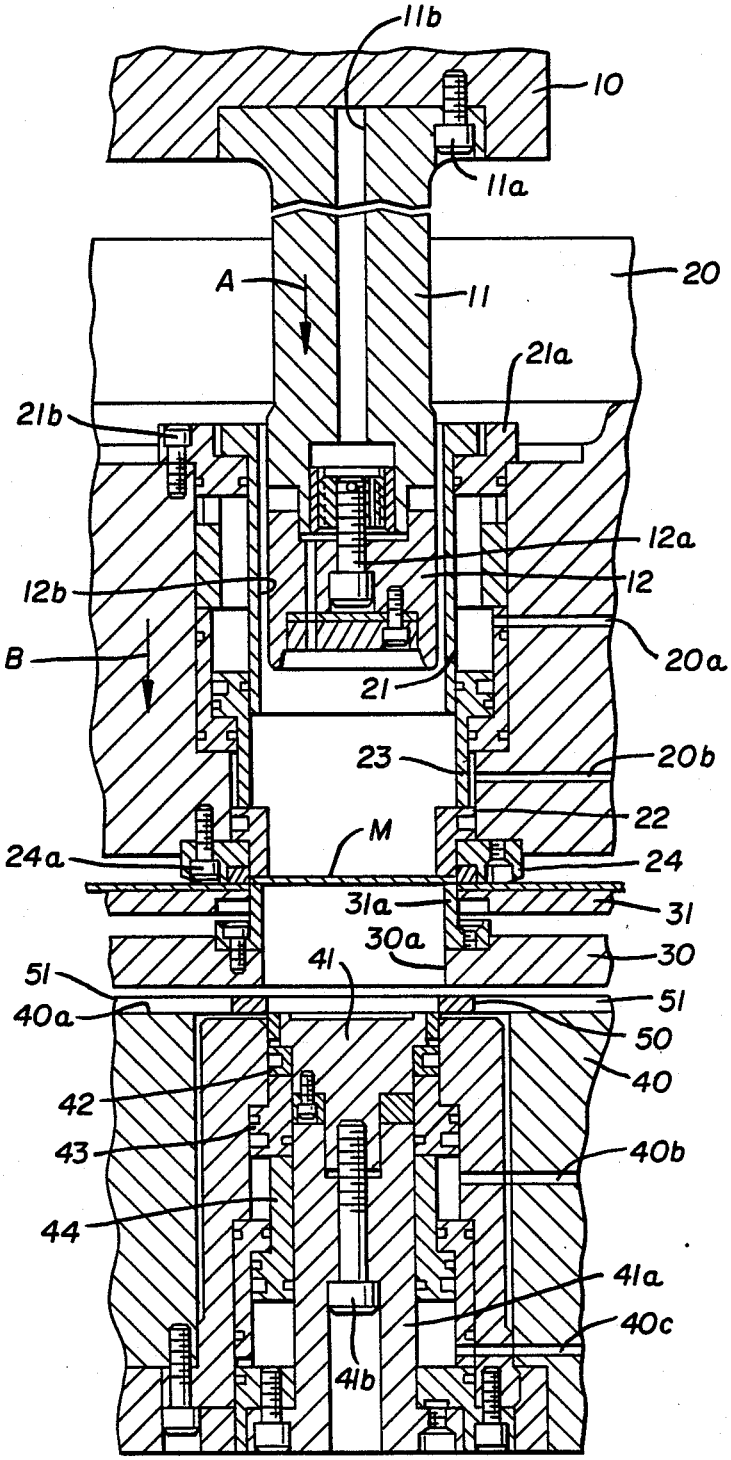
FIG. 3 is an elevational assembly view, partially in section, showing one set of tooling in the blanking position.

With that in mind and referring next to FIGS. 1 and 3 of the drawings, it will be seen that an inner slide holder 10 and an outer slide holder 20 are again illustrated. As noted previously, the drawings illustrate twenty-two sets of tooling carried by these slide holders. Only one tooling set will be described in detail herein.

Thus, the inner slide holder 10 carries a punch riser 11 secured thereto by one or more bolts **11*a*. The projecting end of the punch riser 11 carries a punch 12 secured thereto in adjustable fashion by the screw 12*a*. In this fashion, the tooling such as punch 12 can be moved toward and away from the fixed base of the press as slide holder 10** moves toward and away from the base.

The outer slide holder 20 has an appropriate hollow cavity within which the punch riser 11 and punch 12 of the inner slide holder 10 reciprocate substantially independently of the movement of the outer slide holder.

This outer punch holder 20 also carries with it certain tooling. First, inboard is a sleeve 21 secured thereto by retainer **21*a* and screws 21*b* so as to be reciprocal therewith. Outboard of the sleeve 21 and in concentric surrounding relationship therewith is a first pressure sleeve 22 and a fluid actuated piston 23 which acts thereon. Secured to the projecting bottom end of the outer punch holder 20 is a cut edge 24 which is secured by one or more screws 24*a***.

The fluid actuated piston 23 is carried by outer punch holder 20 above first pressure sleeve 22 and is controlled by fluid introduced through bore **20*a* and vented through bore 20*b* with bore 20*a*** being connected to a suitable source of fluid supply (not shown).

Disposed beneath the inner and outer slide holders 10 and 20 is bolster plate 40 and die holder 30. This bolster plate 40 has a central cavity therein which receives a die core 41 mounted on a die core riser **41*a* and secured thereto by screw 41*b*. Surrounding the die core 41 and die core riser 41*a* is a knockout piston 42 which is supported by fluidly actuated pistons 43 and 44**.

Disposed just above the top surface **40*a* of the base 40 is an apertured belt 50 which has a plurality of apertures 51,51 which are sized appropriately so as to receive an end, as will be described. This belt is movable along top surface 40*a* of bolster plate 40 by suitable drive means 50*a*, 50*a* which may take the form of toothed wheels (see FIGS. 1 and 2), at least one of which is driven. A stock plate 31 and a die holder 30 are also disposed between the slide holders 10 and 20 and the bolster plate 40, as can clearly be seen in FIG. 3 of the drawings. As previously noted, in keeping with the multi-level aspects of the invention, the stock plate 31 is disposed at a first level while the belt 50** is disposed at a second, lower level.

Figure 3A:
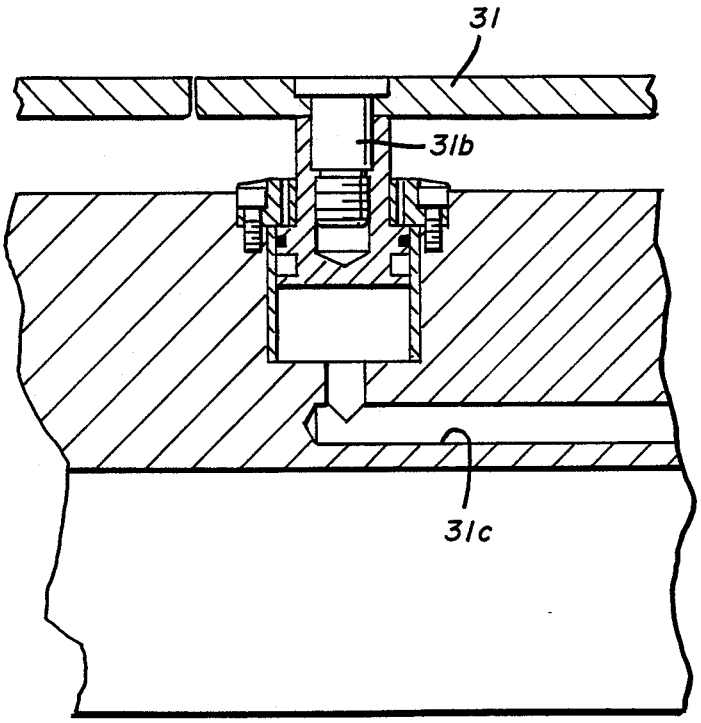
FIG. 3A is an enlarged fragmentary sectional view, partially in section, showing the stock plate support.

The stock plate 31 is supported by one or more fluid supported pistons as can be seen in the enlarged view of FIG. 3A wherein plate 31 is supported by piston **31*b* which, in turn, is supported by fluid supplied through bore 31*c***.

The die holder 30 also carries on it a punch shell and cut edge **31*a* which cooperates with cut edge 24 and stock plate 31** and blanks the material, as will be described subsequently in greater detail.

Figure 7:
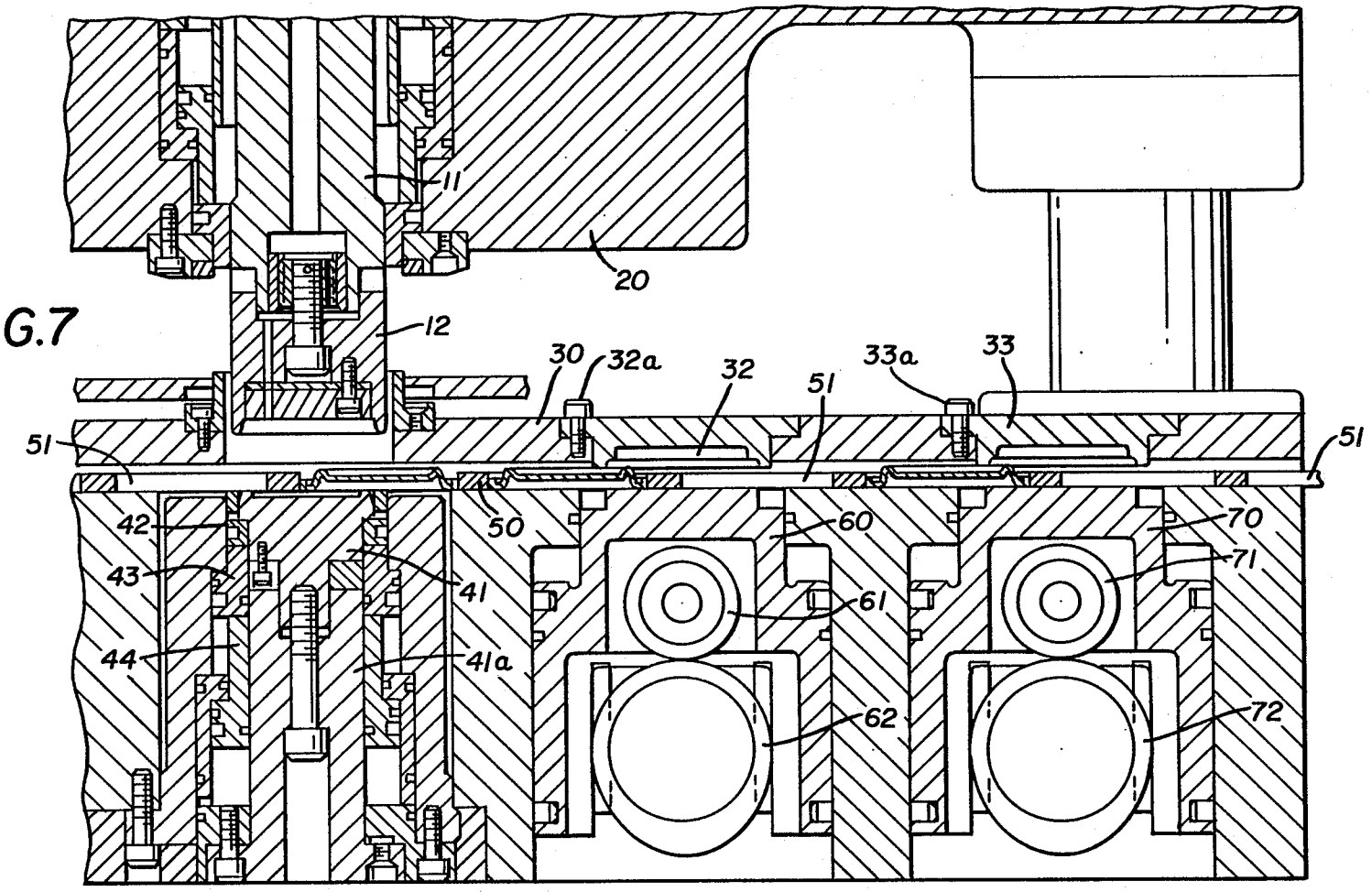
FIG. 7 is an elevational view, partially in section, showing the transfer of the ends from one station to another.

Spaced laterally of the tooling just described in FIG. 3 is tooling suitable for reforming the end and for curling the end, as can be seen in FIGS. 1, 2 and 7 with it being again noted that, in effect, only one primary tooling station and one set of auxiliary tooling is being described in detail.

Figure 8:
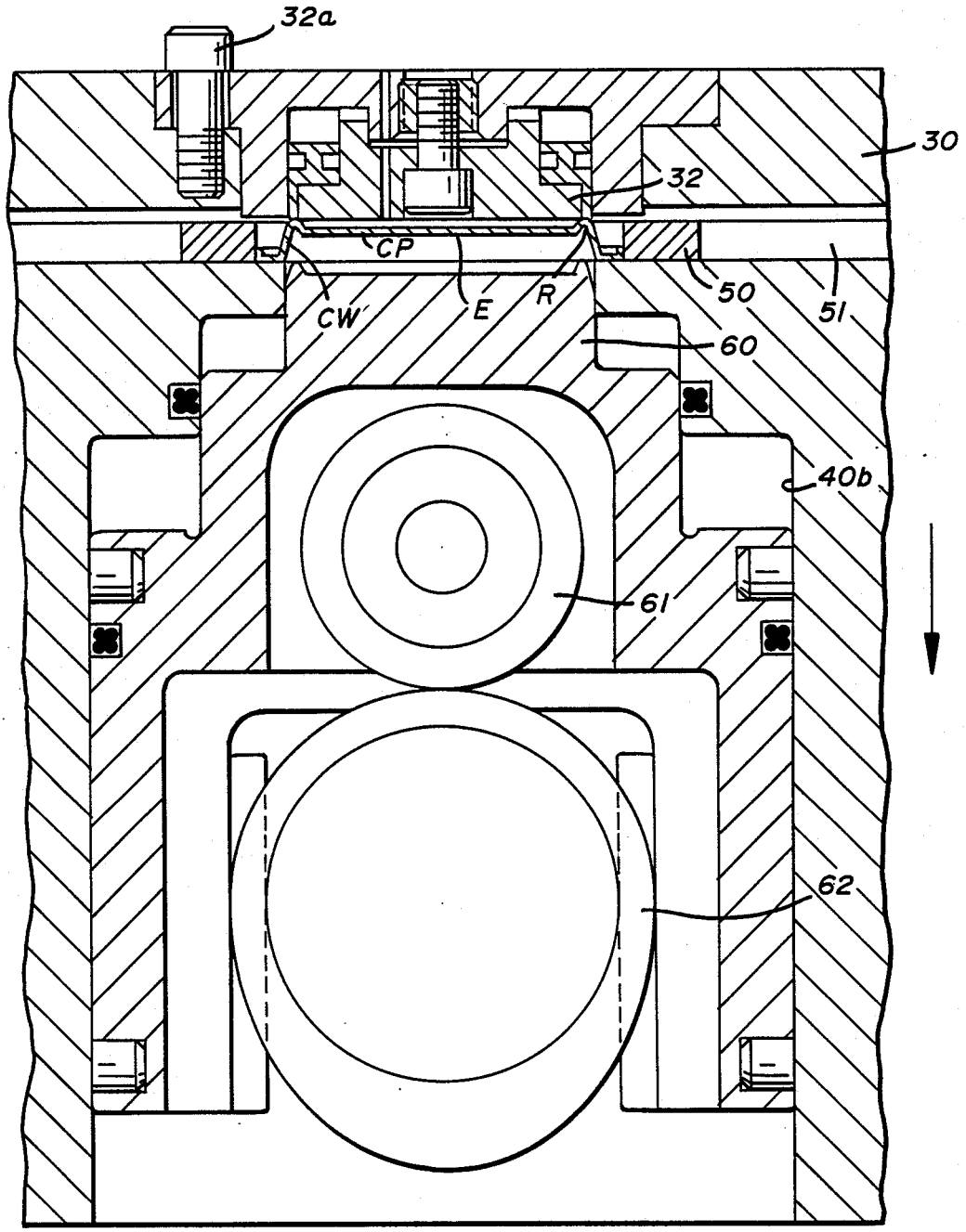
FIG. 8 is an enlarged elevational view, partially in section, showing the tooling for reforming the end in the down or receiving position.
Figure 9:
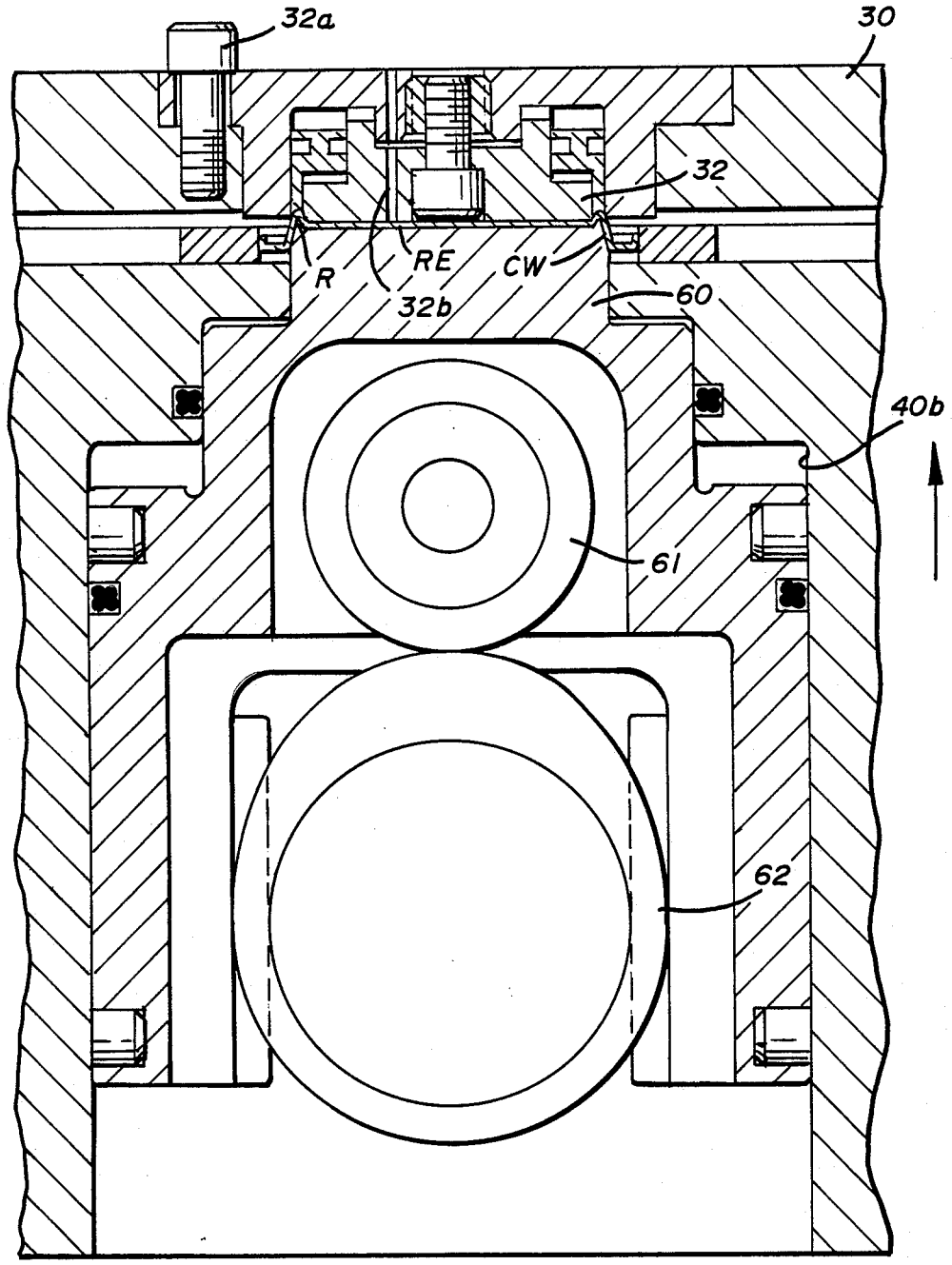
FIG. 9 is an enlarged elevational view, partially in section, showing the tooling for reforming the end in the up or reforming position.

Referring then to FIGS. 7 through 9, the reforming station essentially includes a reforming die 32 carried on the die holder 30 by one or more screws 32*a*. Beneath that die 32 is a punch 60 which is reciprocally mounted in cavity 40*b* of the bolster plate 40. A cam 62 is disposed therein and rotation of the cam by conventional means (not shown) will move the rise of the cam into engagement with cam follower 61 to elevate the punch 60 so as to force the preliminarily formed end up against the die 32 so as to reform it. In FIG. 8, the cam is shown rotated down so as to permit the end E to be moved into and out of position at the reform station. FIG. 9 shows the reform tooling in the up position with the end having been reformed.

Figure 10:
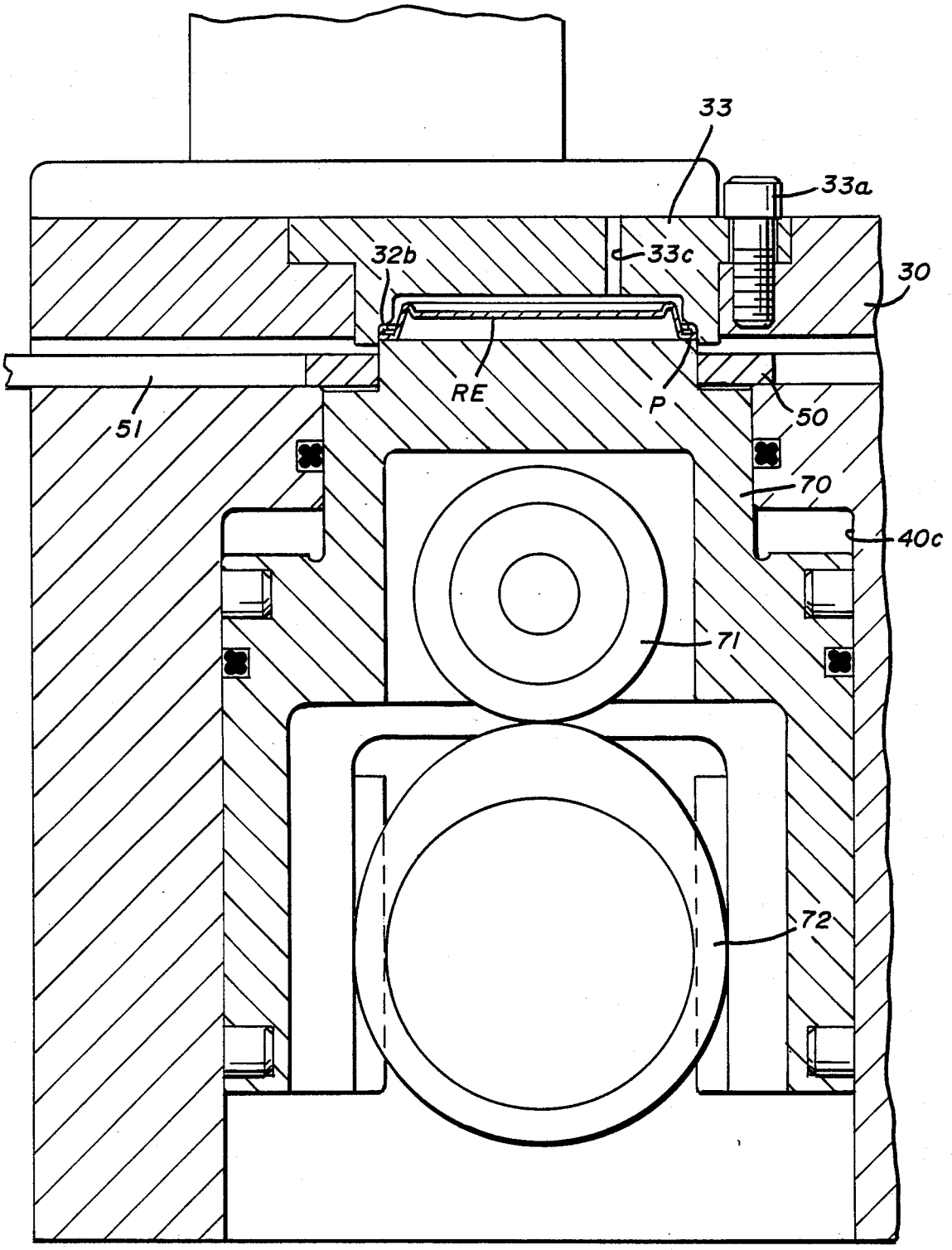
FIG. 10 is an enlarged elevational view, partially in section, showing the tooling for curling the end in the up or curling position.

The curling station illustrated in FIG. 10 is somewhat similar, except that the die 33 is configured somewhat differently so as to curl the peripheral edges of the end. Thus, die 33, which is mounted on die plate 30 by one or more screws 30*a*, has a contoured annular recessed area 33*a* suitable for the curling operation.

The curling punch 70, which is slidably received in bore 40*c* of base 40 is dimensioned so as to support the radiused area of the shell, as shown in FIG. 10. Movement of punch 70 is controlled by cam 72 and cam follower 71. It will readily be noted that the curling tooling is illustrated only in the up position, but would be moved down in a fashion similar to that illustrated with regard to the reform station in FIG. 8 to permit the end to be moved into and out of the station.

It will also be noted that through bore 33*c* is provided in die holder 30 and may be connected to a source of air to assist in moving the curled end back into the belt 50 if required. A similar bore 32*b* is present at the reform station of FIGS. 8 and 9 for the same reason.

In use or operation of the improved device, it will be assumed that the material M is fed into the press along the stock plate 31 in the direction of arrow X (see FIG. 2). The outer slide holder 20 will be moved to the down position of FIG. 3 and fluid pressure exerted on the piston 23 through bore 20*a* will force the first pressure sleeve 22 into holding relationship with the material M. Further downward movement of outer slide holder 20 will cause the cut edge 24 to blank the material against cut edge 31*a*, as can be clearly seen in FIG. 3 of the drawings. In that regard, it will be noted that cut edge 31*a* is carried on die holder 30 and does not move. As previously noted, however, stock plate 31 is fluidly supported (see FIG. 3A). Therefore, downward movement of cut edge 24 will depress stock plate 31 a sufficient distance to permit the blanking operation to take place.

Figure 4:
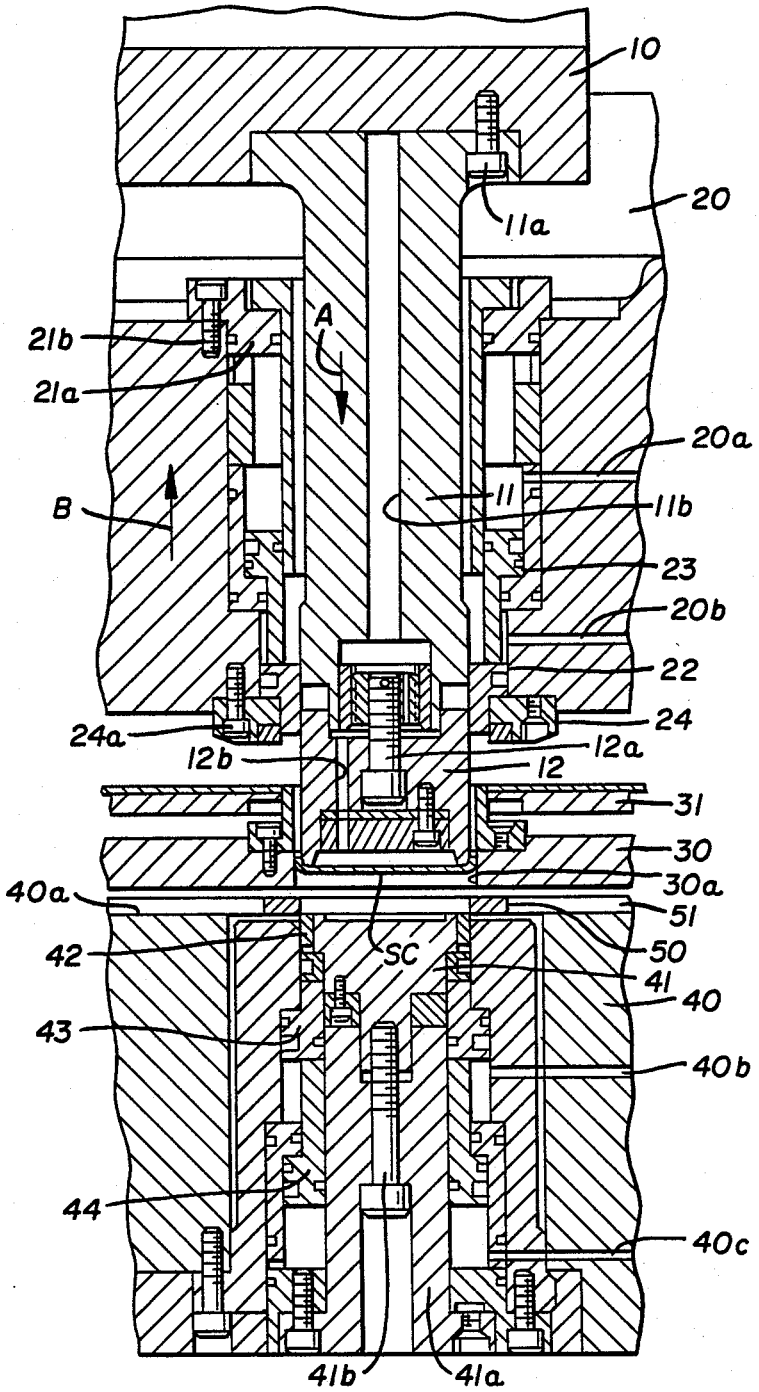
FIG. 4 is an elevational assembly view, partially in section, showing the tooling during formation of the cup.

Turning then to FIG. 4 of the drawings, it will first be noted that stock plate 31 has a through aperture 31*b* and the die holder 30 has a through aperture 30*a*. Continued downward movement of the inner slide holder 10 forces the punch 12 down against the previously blanked material M, pulling it out of its previously clamped position beneath sleeve 22 and forming it into a shallow cup SC. As can be seen in FIG. 4, the inner slide holder 10 continues downwardly, as indicated by the arrow A, while the outer slide holder 20 is retracting. It will also be noted that the shallow cup SC carried on the end of the punch 12 is forced down through the apertures 30*a* and 31*b* in the die holder 30 and stock plate 31 for further operation. As previously noted, this makes it possible to take the cup through the press following initial forming below the entry level of the raw material on the top of stock plate 31, thereby greatly facilitating speed of operation of the apparatus.

Figure 11:
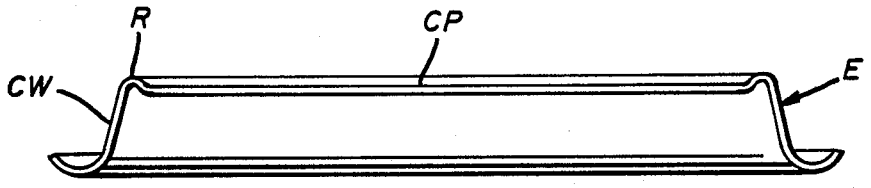
FIG. 11 is a sectional view of the end following the preliminary forming of FIGS. 3 and 4.
Figure 5:
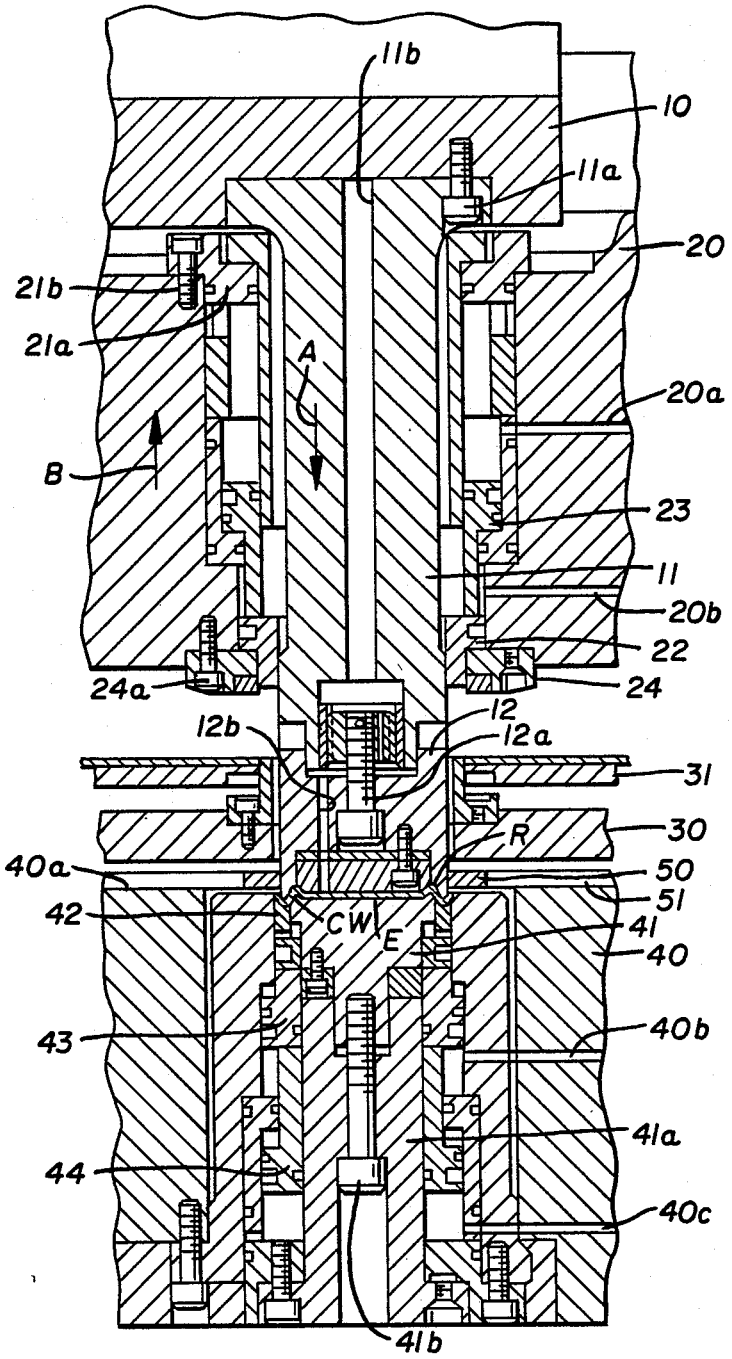
FIG. 5 is an elevational assembly view, partially in section, showing the tooling during the preliminary forming of the end.

Turning then to FIG. 5 of the drawings, it will be seen that a preliminarily formed end E having the general configuration of that shown in FIG. 11 of the drawings will be formed. This is accomplished by continued downward movement of the inner slide holder 10 carrying the shallow cup SC of FIG. 4 down through the aperture 30*a* and the die holder 30 until it contacts the die core 41 carried by the bolster 40. This die core is fixed, but the liftout ring 42 is not fixed. Thus, movement of the contoured nose of the punch 12 against the die core 41 will force the knockout ring 42 down and preliminarily form the chuckwall CW and radiused area R of the end E (see FIGS. 5 and 11). It will also be noted here that the punch 12 has passed through one of the apertures 51 in the belt 50 and forced end E therethrough as well.

Figure 6:
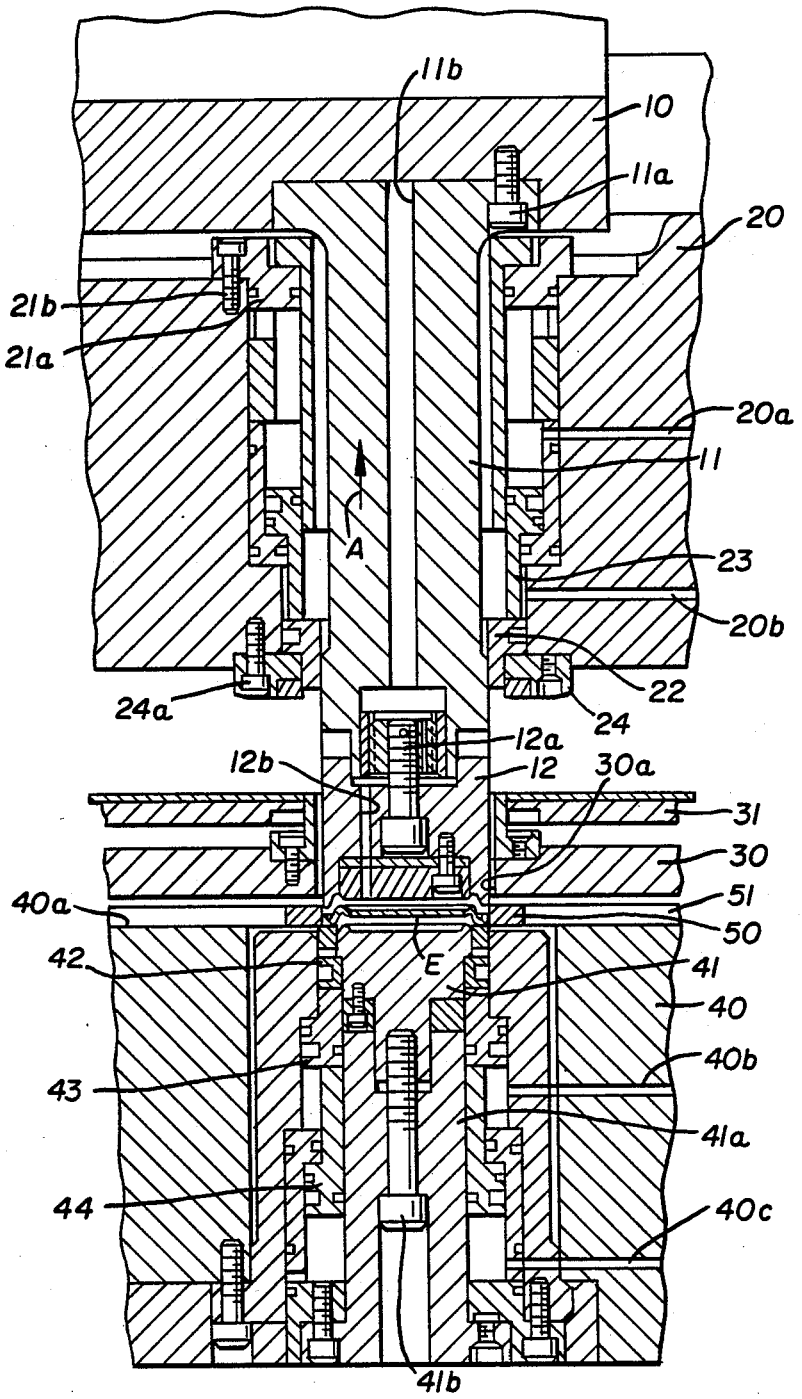
FIG. 6 is an elevational assembly view, partially in section, showing the tooling with the end preliminarily formed and lifted back to the die line.

Referring next then to FIG. 6 of the drawings, it will be seen that the inner slide holder 10 has begun to move upwardly away from the base 40. As soon as the punch 12 lifts off, the fluid pressure on pistons 43 and 44 through bores 40*b* and 40*c* from a suitable source (not shown) will push the knockout ring 42 upwardly and it in turn will push the end E up to the position of FIG. 4. At that time, the end is frictionally engaged by belt 50 and held in one of the apertures 51 thereof. As soon as the punch 12 clears the belt 50, the belt can be indexed to an idle station and on to the next adjacent station, as shown clearly in FIG. 7 of the drawings, wherein a series of preliminarily formed ends E are shown deposited in various pockets 51 of the belt 50. It should be noted that in some instances it may be necessary to apply air through bores 12*b* and 11*b* of punch 12 and riser 11 to strip the end from the punch.

It should be kept in mind at this point that the end has the general configuration shown in FIG. 11 of the drawings at this stage of the operation.

Referring next to FIG. 8 of the drawings, and assuming that the belt 50 has been indexed sufficiently so as to bring the preliminarily formed end E to the position illustrated in FIG. 8, it will be noted that the cam 62 is rotated down so that the punch 60 is in its retracted position. This, of course, makes it possible to move the end into the position shown in FIG. 8. Rotation of the cam 62, however, as shown in FIG. 9, will move the punch 60 upwardly. The punch 60 has a contoured top surface so that it engages the center panel CP. This upward movement of punch 60 against the die 32 will bring the center panel CP of the end up into contact with the die 32. However, since the punch 60 is engaging the radiused area R of the end, this movement will push the wall area CW over the die 32 and tighten radius R and, in effect, reform the end to form a reformed end RE.

Figure 12:
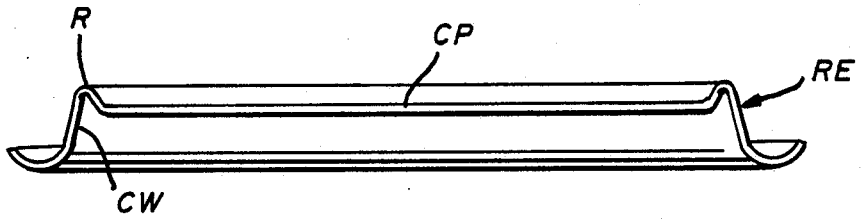
FIG. 12 is a sectional view of the end following the reforming of FIG. 6.

Of course, continued movement of the cam about its center point will permit the punch 60 to drop back down to the position of FIG. 8 whereupon indexing of the belt 50 will move the reformed end RE, which now has the configuration of FIG. 12 of the drawings, to the next station. As previously noted, bore 32*b* may be connected to a source of pressurized air to assist in returning the reformed end RE to the belt if required.

Figure 13:
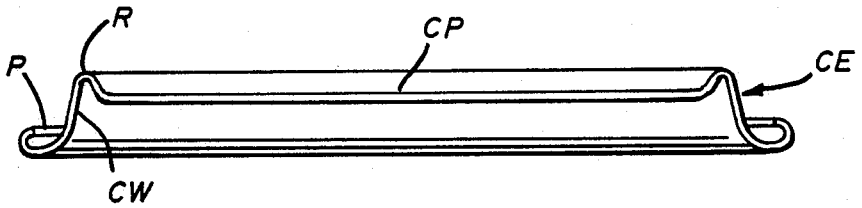
FIG. 13 is a sectional view showing the end following the curling of FIG. 7.

Reference is now had to FIG. 10 of the drawings wherein the curling station is shown. As previously noted, the tooling here is illustrated in the up or operative position only. The cam 72 and cam follower 71 of this station are similar to that of the station illustrated in FIG. 8. Here, however, the die 33 carried by die plate 30 is of a different configuration and has an annular pocket 33*b* suitable for curling the peripheral edge of the end. In that regard, it will be noted that punch 70 is configured so as to support the end RE about its periphery so that, when the end is forced into pocket 31*b*, the curling operation will be performed. It is believed readily apparent that when the cam 72 is rotated about its center point, the punch 70 will drop down. This further rotation of cam 72 will naturally permit the end to drop down and permit the completed end, which now has the configuration of FIG. 13 of the drawings, to be again deposited in one of the pockets 51 of the belt 50 so that indexing of the belt will remove the end from the station and move it on for further processing.

It is possible that some assistance may be required to strip the end in both the reforming and curling stations as already noted. Thus, air passage 33*c* may be employed at the curling station.

It will be seen then how a system has been provided in which multiple operations from blanking to curling can be provided in a single press at high speeds with minimal handling and positive control during the various operations.

The multi-level and positive transfer arrangement makes it possible to achieve very high operational speeds while safely controlling and handling the ends.

While a full and complete description of the invention has been set forth in accordance with the dictates of the Patent Statutes, it should be understood that modifications can be resorted to without departing from the spirit hereof or the scope of the appended claims.

In that regard, it will be noted that the invention has been illustrated in connection with the forming of beverage container ends, but sanitary ends having a profiled surface could also be produced thereby by adding profiling tooling to the stations illustrated in FIGS. 3 through 6.

Additionally, while Applicant has illustrated and described a cam actuated operation at the reforming and curling stations, other activating means such as pistons, for example, could be employed.

Finally, the invention is not intended to be limited to the production of circular ends, but can also be used to produce other shapes such as rectangular, oblong or irregularly shaped and sized ends.

What is claimed is:

1. A method of forming a container end panel from a sheet of material, comprising the steps of:

(a) clamping the sheet of material between opposed pressure members and forming a blank from the sheet of material;

(b) forming a cup from the blank in a continuous press stroke while continuing clamping of the periphery of said blank between said opposed pressure members during a portion of the forming operation;

(c) imparting a preliminary end panel configuration to said cup in the same continuous press stroke; and (d) passing said cup through the die used for forming the cup prior to step c.

2. The method of claim 1 wherein said cup having a preliminary end panel configuration is transferred laterally with respect to the longitudinal centerline of the press following step d.

3. The method of claim 2 wherein the material is received and blanked at a first level and is transferred laterally after step d at a second level.

4. The method of claim 3 wherein said cup is reformed at a first station within the press.

5. The method of claim 4 wherein said cup is curled at a second station within the press.

6. The method of claim 6 wherein said second station is disposed laterally with respect to the longitudinal centerline of the press.

7. The method of claim 3 wherein said first station is disposed laterally with respect to the longitudinal centerline of the press.

8. Apparatus for forming a container end panel from a sheet of material in a double acting press having inner and outer slide holders reciprocal with respect to a fixed base, comprising:

(a) a punch carried by the inner punch holder;

(b) a first cut edge carried by the outer punch holder;

(c) a stock plate resiliently mounted between the inner and outer slide holders and the base and beneath the sheet of material and having a through opening therein;

(d) a die holder disposed between the inner and outer slide holders and the fixed base and having a through aperture in axial alignment with said through aperture in said stock plate;

(e) a second cut edge carried by said die holder and projecting into said opening in said stock plate;

(f) said first cut edge being movable toward the base to blank the material in cooperation with said second cut edge;

(g) a die core carried by the fixed base;

(h) said punch being movable through said apertures in said stock plate and said die holder to engage the blank and preliminarily form the end panel in cooperation with said die core on a second level; and (i) transfer means disposed on the second level to transfer the preliminarily formed end laterally with respect to the horizontal centerline of the press.

9. The apparatus of claim 8 wherein a reforming station is disposed in the press adjacent said die core on the second level; said transfer means operationally interconnecting said die core and said reforming tooling.

10. The apparatus of claim 9 wherein said reforming station includes a reform punch carried by the base and movable toward said die holder; and a reform die carried by said die holder.

11. The apparatus of claim 10 wherein a cam and cam follower are carried by the base for engagement with said reform punch for movement thereof toward said reform die.

12. The apparatus of claim 10 wherein said reform die has at least one through air passage therein.

13. The apparatus of claim 9 wherein a curling station is disposed in the press on the second level; said transfer means operationally interconnecting said reforming station and said curling station.

14. The apparatus of claim 13 wherein said curling station includes a curling punch carried by the base and movable toward said die holder; and a curling die carried by said die holder.

15. The apparatus of claim 14 wherein a cam and cam follower are carried by the base for engagement with said curling punch for movement thereof toward said curling die.

16. The apparatus of claim 14 wherein said curling die has at least one through air passage therein.

17. The apparatus of claim 9 wherein said transfer means includes an apertured, endless belt partially disposed at the second level and spanning the distance between said die core and said reforming station.

18. The apparatus of claim 13 wherein said transfer means includes an apertured, endless belt partially disposed at the second level and spanning the distance between said die core and said reform and said curling stations.

19. Apparatus for forming a container end panel from a sheet of material in a double acting press having inner and outer slide holders reciprocal with respect to a fixed base, comprising:

(a) at a first station, tooling carried by the inner and outer slides and the base for clamping the material and blanking the material at a first level and preliminarily forming the blanked material into end panel configuration at a second level while continuing to hold pressure on the blank;

(b) at a second station disposed adjacent said first station, tooling carried by the base at the second level for reforming the preliminarily formed end panel;

(c) at a third station disposed adjacent said second station, tooling carried by the base for curling the reformed end panel; and (d) transfer means carried by the base at the second level and interconnecting said first, second and third stations.

20. Apparatus for forming container end panels from a sheet of material in a press, comprising:

(a) parallel rows of blanking and forming tooling carried by the press and disposed transverse to the direction of feed of the material into the press and along one horizontal axis of the press;

(b) parallel rows of reform tooling carried by the press and disposed parallel to said rows of blanking and forming tooling and laterally outboard thereof;

(c) parallel rows of curling tooling carried by the press and disposed parallel to said rows of reform tooling and laterally outboard thereof;

(d) said reform tooling and said curling tooling being disposed beneath the level of entry of the material into the press; and (e) transfer means carried by the base for transferring end panels between said blanking and forming tooling, said reform tooling and said curling tooling.

21. The apparatus of claim 20 wherein said transfer means are disposed adjacent the level of said reform and curling tooling and include a plurality of endless, apertured belts extending outwardly from said one horizontal axis of the press.

* * * * *

UNITED STATES PATENT AND TRADEMARK OFFICE

CERTIFICATE OF CORRECTION

PATENT NO. : 4,903,521

DATED : February 27, 1990

INVENTOR(S) : Joseph D. Bulso, Jr. et al.

It is certified that error appears in the above-identified patent and that said Letters Patent is hereby corrected as shown below:

On the first page of the patent under the heading "ABSTRACT", Line 3, delete "banking" and substitute therefor --blanking--.

In Column 3, Line 33, delete "preliminary" and substitute therefor --preliminarily--.

In Column 8, Line 5, delete "6" and substitute therefor --5--.

Signed and Sealed this

Twenty-third Day of April, 1991

*Attest:*

HARRY F. MANBECK, JR.

*Attesting Officer*

*Commissioner of Patents and Trademarks*